US009016188B2

(12) United States Patent
Larson et al.

(10) Patent No.: US 9,016,188 B2
(45) **Date of Patent: *Apr. 28, 2015**

(54) FIREARM HAVING GAS PISTON SYSTEM

(71) Applicant: Rock River Arms, Inc., Colona, IL (US)

(72) Inventors: Mark Larson, Colona, IL (US); Lester Larson, Jr., Colona, IL (US)

(73) Assignee: Rock River Arms, Inc., Colona, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/202,059

(22) Filed: Mar. 10, 2014

(65) Prior Publication Data

US 2015/0007712 A1 Jan. 8, 2015

Related U.S. Application Data

(63) Continuation of application No. 13/921,917, filed on Jun. 19, 2013, now Pat. No. 8,667,883, which is a continuation of application No. 13/102,331, filed on May 6, 2011, now Pat. No. 8,468,929.

(60) Provisional application No. 61/332,048, filed on May 6, 2010.

(51) Int. Cl.

| | |
|---|---|
| ***F41A 5/18*** | (2006.01) |
| ***F41A 3/66*** | (2006.01) |
| ***F41A 5/26*** | (2006.01) |
| ***F41A 7/00*** | (2006.01) |
| ***F41C 23/16*** | (2006.01) |
| ***F41C 27/00*** | (2006.01) |
| ***F41A 5/28*** | (2006.01) |
| ***F41A 21/34*** | (2006.01) |
| ***F41A 35/06*** | (2006.01) |
| ***F41C 23/10*** | (2006.01) |
| ***F41G 11/00*** | (2006.01) |
| ***F41C 23/04*** | (2006.01) |

(52) U.S. Cl.

CPC ... *F41A 5/18* (2013.01); *F41A 5/28* (2013.01); *F41A 21/34* (2013.01); *F41A 35/06* (2013.01); *F41C 23/10* (2013.01); *F41G 11/003* (2013.01); *F41C 23/04* (2013.01); *F41A 3/66* (2013.01); *F41A 5/26* (2013.01); *F41A 7/00* (2013.01); *F41C 23/16* (2013.01); *F41C 27/00* (2013.01)

(58) Field of Classification Search

CPC ..... F41A 3/66; F41A 5/18; F41A 5/20; F41A 5/26; F41A 5/28; F41A 35/06; F41C 23/16; F41G 11/003

USPC ..... 89/191.01, 191.02, 192, 193

See application file for complete search history.

(56) References Cited

U.S. PATENT DOCUMENTS

| | | | |
|---|---|---|---|
| 1,572,450 | A | 2/1926 | Sweblius |
| 4,058,922 | A | 11/1977 | Elbe et al. |
| 4,326,353 | A | 4/1982 | Ludwig et al. |
| 4,521,985 | A | 6/1985 | Smith et al. |
| 4,579,034 | A | 4/1986 | Holloway |

(Continued)

*Primary Examiner* — Bret Hayes

(74) *Attorney, Agent, or Firm* — Banner & Witcoff, Ltd.

(57) ABSTRACT

A firearm having a gas piston system includes a bolt carrier, an adjustable gas piston block located forward on the firearm and an over-the-barrel spring and guide rod arrangement, all of which is housed and contained in a top rail that runs the length of the firearm and that maintains the alignment of these firearm components. The firearm also includes an ambidextrous, non-reciprocating charging handle located forward on the firearm and positioned within the top rail for charging the firearm.

16 Claims, 9 Drawing Sheets

(56) References Cited

U.S. PATENT DOCUMENTS

| | | | | |
|---|---|---|---|---|
| 4,615,134 | A | 10/1986 | Beretta | |
| 4,709,496 | A | 12/1987 | Johnson | |
| 5,519,954 | A | 5/1996 | Garrett | |
| 5,588,241 | A | 12/1996 | Hurley | |
| 6,293,040 | B1 | 9/2001 | Luth | |
| 6,694,660 | B1 * | 2/2004 | Davies | 42/75.01 |
| 6,722,255 | B2 | 4/2004 | Herring | |
| 6,848,351 | B1 * | 2/2005 | Davies | 89/191.01 |
| 7,219,462 | B2 | 5/2007 | Finn | |
| 7,469,624 | B1 | 12/2008 | Adams | |
| 7,798,045 | B1 | 9/2010 | Fitzpatrick et al. | |
| 7,832,326 | B1 | 11/2010 | Barrett | |
| 8,468,929 | B2 | 6/2013 | Larson et al. | |
| 8,667,883 | B1 * | 3/2014 | Larson et al. | 89/193 |
| 2006/0065112 | A1 | 3/2006 | Kuczynko et al. | |
| 2007/0199435 | A1 | 8/2007 | Hochstrate et al. | |
| 2010/0000400 | A1 | 1/2010 | Brown | |
| 2012/0180647 | A1 | 7/2012 | Dublin | |
| 2012/0260793 | A1 | 10/2012 | Gomez | |

* cited by examiner

FIREARM HAVING GAS PISTON SYSTEM

CROSS REFERENCE TO RELATED APPLICATION

This application is a continuation of application Ser. No. 13/921,917 filed on Jun. 19, 2013, now U.S. Pat. No. 8,667,883, which is a continuation of application Ser. No. 13/102,331, filed May 6, 2011, now U.S. Pat. No. 8,468,929, which claims benefit to U.S. Provisional Application Ser. No. 61/332,048 filed May 6, 2010, all of which are incorporated herein by reference.

FIELD OF THE INVENTION

The present invention relates generally to firearms and more particularly to an improved firearm that utilizes a performance gas piston driven system.

BACKGROUND OF THE INVENTION

Firearms having a direct gas impingement system or an indirect gas impingement system are known. Direct gas impingement is a type of gas operation for a firearm that directs gas from a fired cartridge directly to the bolt carrier or slide assembly to cycle the action in the firearm. More specifically, in a direct gas impingement system, when the firearm is fired, the exhaust propellant gases from the fired cartridge are directed through a port at the end of the barrel and then channeled back to the bolt carrier and will strike, or impinge, the bolt carrier moving it rearward toward the buttstock and into a retracted position. The exhaust gases will then discharge out the ejection port on the side of the firearm near the buttstock. After discharge, the spring acting on the bolt carrier will move the bolt carrier back to the engaged position at the same time stripping or picking up another cartridge from the magazine and moving that cartridge into a battery position within the firearm's breech. Examples of direct gas impingement firearms include the AR-15, M4 and M16 style firearms.

There are several known disadvantages with a direct gas impingement system. As an example, one disadvantage is that the breech of the firearm becomes fouled more quickly. This is caused by solids and impurities from the high-temperature gas from the fired cartridge condensing as they cool and being deposited on the bolt face and primary operating mechanism. Thorough and frequent cleaning is required to ensure reliability and proper operation of the firearm's operating mechanism. The amount of fouling depends upon the firearm's design as well as the type of propellant powder used in the fired cartridge.

A further disadvantage of direct gas impingement systems is that combustion gases from the fired cartridge heat the bolt and bolt carrier as the firearm operates. This heating may alter the temper of metal parts, accelerating wear and decreasing the service life of the bolt, extractor, and extractor spring. Additionally, heat dries up the firearm's lubricant and makes the firearm's operating parts difficult to handle when clearing malfunctions. Heat can also melt the lacquer coatings of steel cartridge cases, gumming up parts. Moreover, thermal expansion in the firearm's action can result in loss of tolerances and consequent degradation in the firearm's accuracy.

Firearms having an indirect gas impingement system differ from the direct gas impingement system in that the exhaust gases do not directly act on the bolt carrier. Rather, the exhaust gases, after the firearm has been fired, act on and move a piston-type rod that, in turn, is operatively connected to the bolt carrier. The movement of the piston-type rod moves the bolt carrier rearward, or in the direction opposite to the fired bullet, and to a retracted position. Once the piston has traveled a certain distance, the remaining unused gas acting on the piston-type rod is discharged through a port on the firearm. A spring acting on the piston will then move the rod and accompanying bolt carrier forward, picking up a new cartridge, and moving that cartridge into the battery position.

In contrast to the direct gas impingement system, a benefit of the indirect gas impingement system is a higher level of reliability by running a cleaner and cooler firearm by moving the operation of the firearm from the upper receiver and bolt carrier to a gas block using a small diameter short stroke piston which does not require constant cleaning or lubrication like the direct gas impingement system does in order to ensure functionality.

There remains, however, a need in the art for an improved indirect gas impingement system for a firearm.

SUMMARY OF THE INVENTION

In an aspect of the present invention, a firearm having a gas piston system includes a bolt carrier, an adjustable gas piston block located forward on the firearm and an over-the-barrel spring and guide rod arrangement, all of which is housed in a top rail that runs the length of the firearm and that maintains the alignment of these firearm components. The firearm also includes an ambidextrous, non-reciprocating charging handle located forward on the firearm and positioned within the top rail for charging the firearm. With the invention, the traditional direct impingement system is completely eliminated and the problems associated therewith. Additionally, with the present invention, no buffer assembly is required, allowing for the mounting on the firearm of a side-folding stock of many different configurations. The invention improves upon the known indirect impingement systems in a number of ways, as explained below and illustrated in the drawings.

DESCRIPTION OF DRAWINGS

The present invention is illustrated by way of example and not limited in the accompanying figures in which like reference numerals indicate similar elements and in which.

DESCRIPTION OF THE EMBODIMENTS

Figure 1:
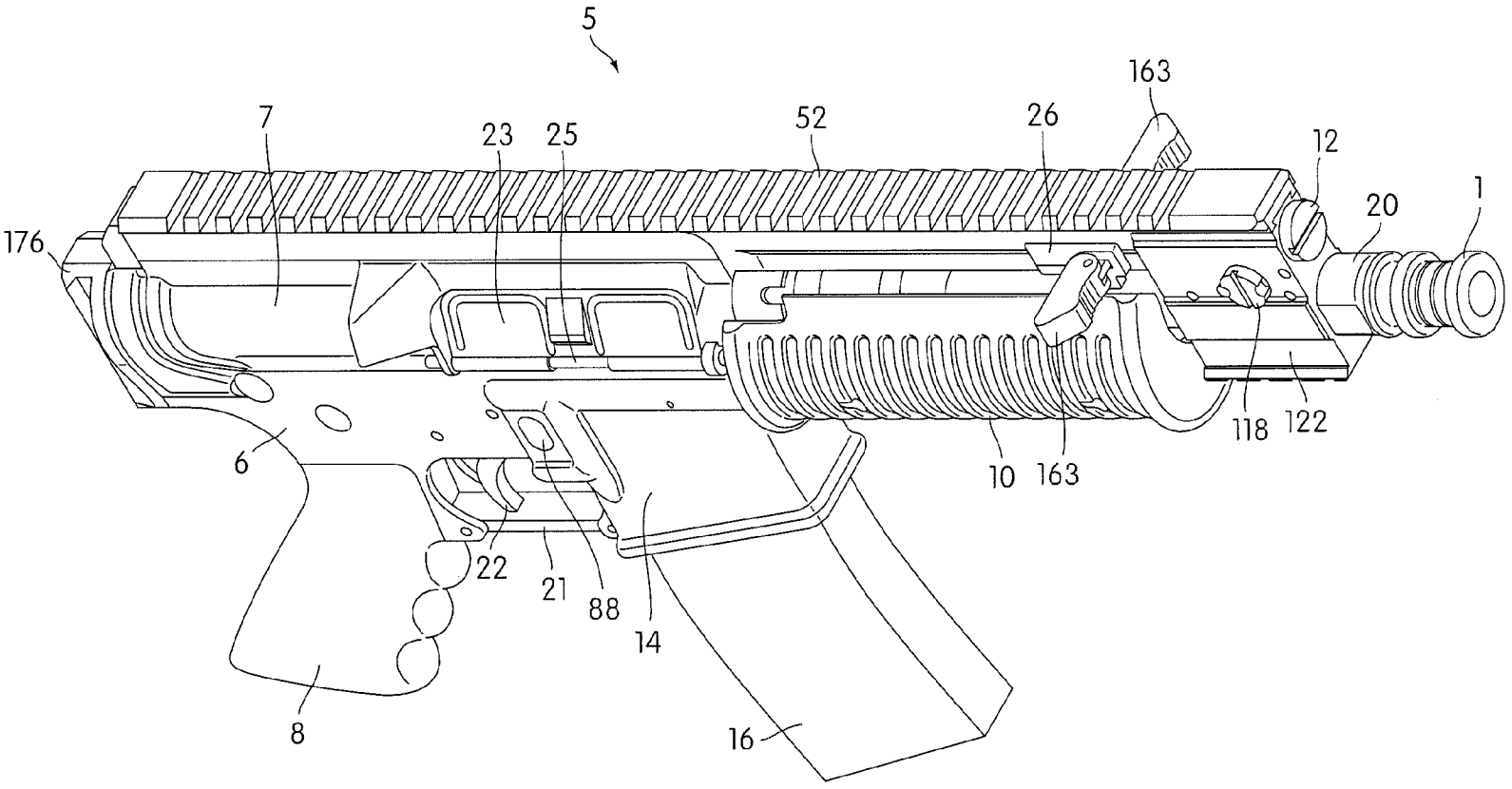
FIG. 1 illustrates an isometric view of an exemplary firearm for use with the teachings of the invention.

The firearm 5 of the invention is depicted in the figures and includes an adjustable performance gas piston system located forward on the firearm in front of the handguard and away from the operator, a purpose-designed bolt carrier, and an over-the-barrel spring and guide rod arrangement, all of which is housed and held in position by a top rail that runs the length of the firearm and that maintains the alignment of these firearm components. A hard polymer handguard is used to protect the operator's hands during operation of the firearm. With the firearm 5, the traditional direct impingement system is completely eliminated and the problems associated therewith. Additionally, the absence of the traditional direct impingement operating system means that no buffer assembly is required, allowing for the mounting on the firearm 5 of a side-folding stock of many different configurations. For the pistol version of the firearm this means a clean, pistol-like profile without the naked buffer tube extending out the back of the pistol. An added benefit of the invention is that the design of the upper receiver and guide rod base prevents gas blow-by to the back of the receiver and to the operator's face. The firearm of the invention may be in the form of a pistol, carbine or a rifle, and the performance piston driven system of the invention may be incorporated into any of these forms of firearms. The firearm of the invention will work for various calibers such as .223, .243, 5.56 mm, 9 mm, .308, .40, and others. The gas piston system of the invention will work with any standard AR-style receiver and other firearm platforms.

Additional aspects of the firearm 5 include a piston system that will direct the discharged gases in front of the front handguard system and through a specially designed gas piston regulator housing block and not to the back of the firearm. Further, the firearm of the invention uses an ambidextrous, non-reciprocating charging handle mounted at the forward end of the firearm and in the top rail, the handle having foldable ears which may be used singly or in unison to charge the firearm. The handguard mounting system, as more fully explained below, is more rigid and easier to change out than traditional handguards and eliminates the delta or handguard slip ring. The handguard may be changed out to use a handguard system having one or more mounting rails. The use of the adjustable gas system allows for adjustment of different ammunition and climate changes. The gas regulator used with the system may be a two position regulator. The slide-in top rail extending the length of the firearm serves as a guide to hold and a means to align the bolt carrier, the piston gas regulator housing and the piston rod assembly. Additionally, the mounting rail which not only aligns the various components of the firearm also may be used to mount lights, lasers, optics and other accessories. Moreover, the mounting rail is also the guide for the charge handle which is located at the forward end of the firearm. The firearm also uses a rear mounting rail that may be mounted on the rear receiver adapter and that may be used to mount a sling mount. For the carbine or rifle version of the firearm, a foldable stock may be mounted to the rear receiver adapter or to the rear of the receiver. Also, the gas regulator housing may include a mounting rail on one of its sides to mount a sling mount, weapon lights or other accessories. These unique aspects, among others, of the invention are further described below and illustrated in the drawings.

Figure 7:
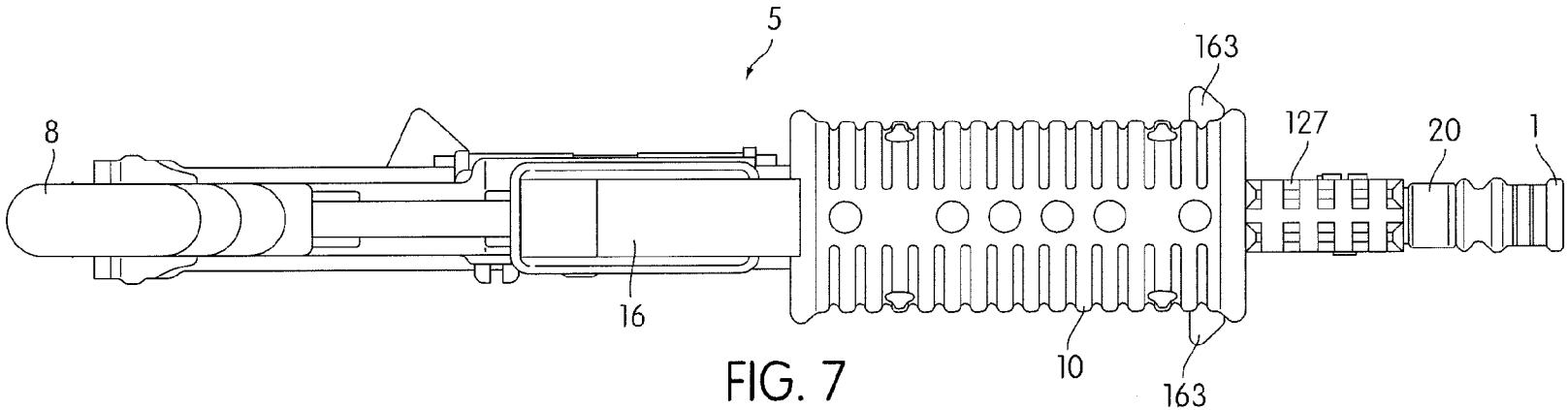
FIG. 7 illustrates a bottom view of the firearm of FIG. 1.
Figure 8:
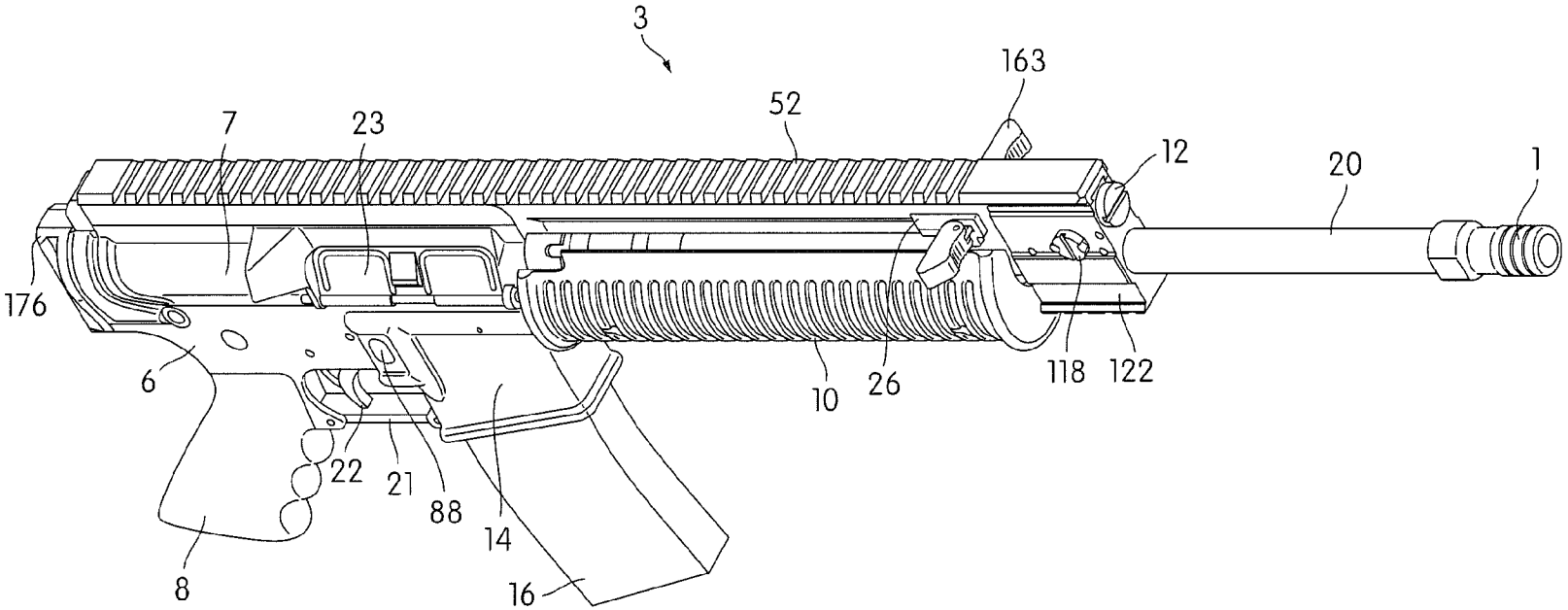
FIG. 8 illustrates an isometric view of an alternative exemplary firearm for use with the teachings of the invention.
Figure 9:
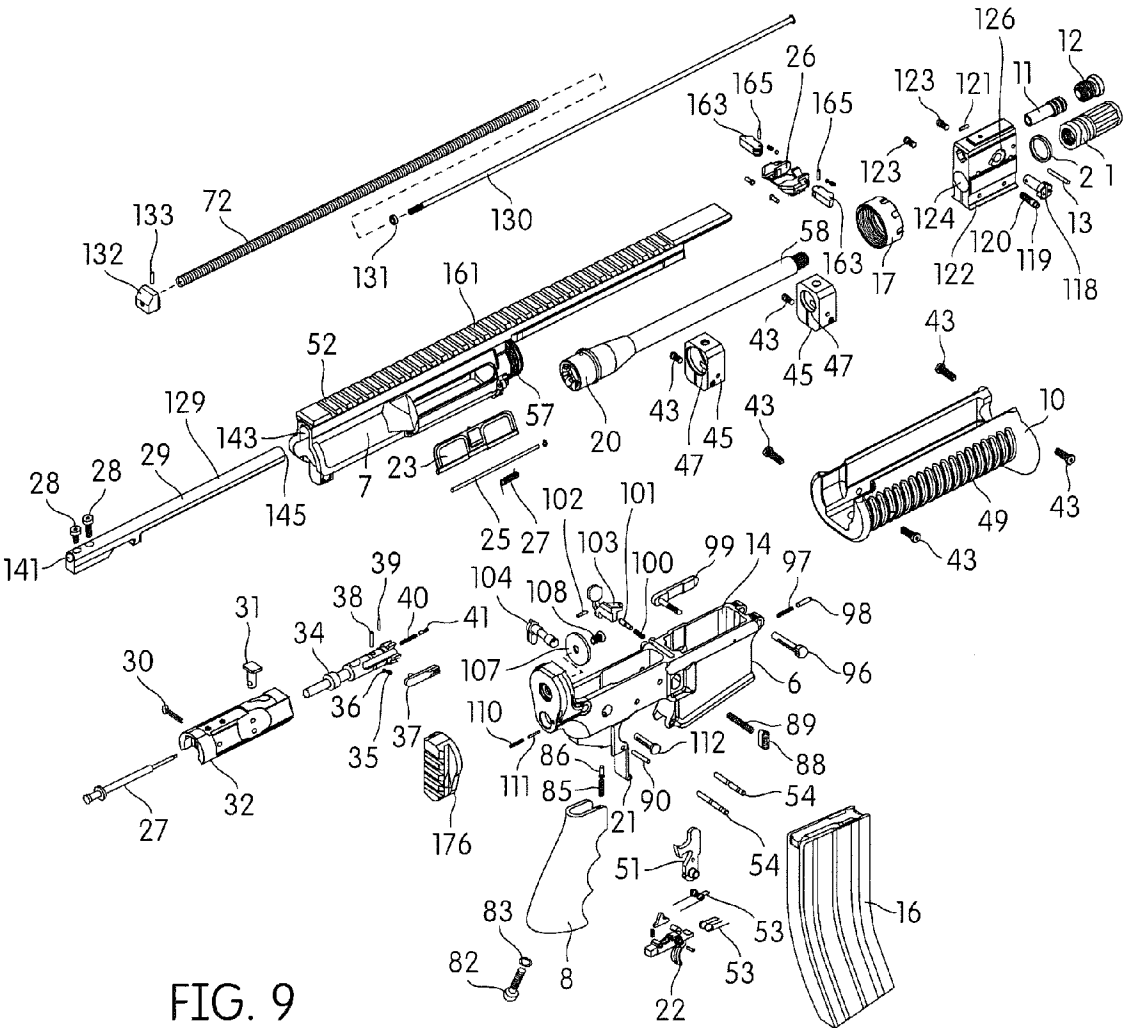
FIG. 9 illustrates an exploded view of the components of the firearm of FIG. 1.
Figure 11:
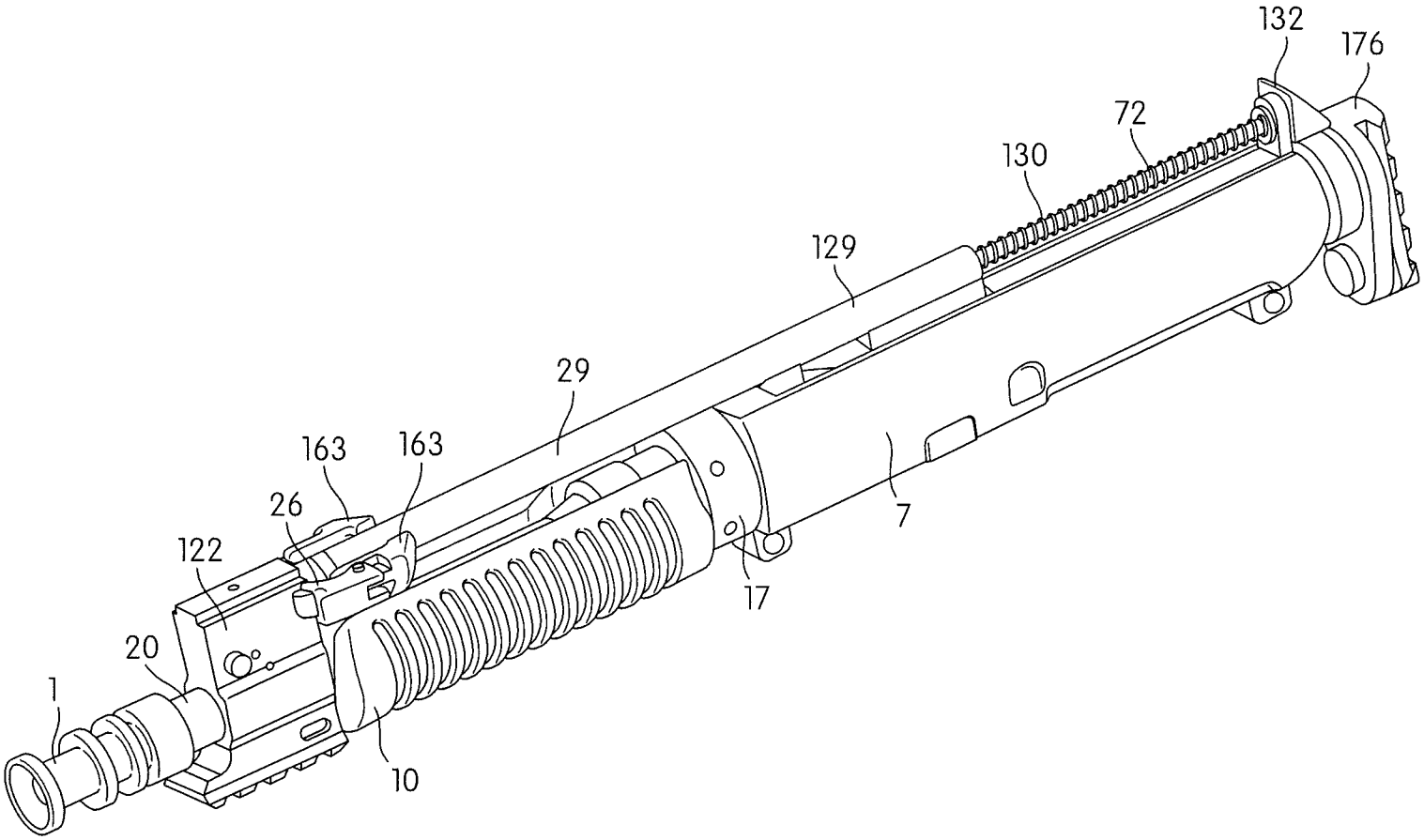
FIG. 11 illustrates an isometric view of a partial firearm of FIG. 1 with the top mounting rail removed.

Referring to FIGS. 1-9 and 11, FIG. 1 illustrates an isometric view of pistol version of a firearm 5 of the invention, and FIGS. 2-7 illustrate various views of the firearm 5 of FIG. 1. FIG. 8 illustrates a carbine version of the firearm 5 of the invention. The primary difference between the carbine version and the pistol version is the length of the barrel, handguard and top rail. FIG. 9 illustrates an exploded view of the various components of the firearm 5. FIG. 11 illustrates a partial view of the firearm 5 with the top mounting rail removed. As depicted in FIGS. 1-9 and 11, the firearm 5 generally includes a lower receiver 6, an upper receiver 7 mounted to the lower receiver, a pistol hand grip 8 mounted to the lower receiver, a handguard 10 mounted around a barrel 20, a magazine well 14 formed in the lower receiver for receiving a magazine 16 that contains live rounds or cartridges, not shown. The firearm 5 also includes a trigger 22 and a trigger guard 21 that is pinned to the lower receiver and located between the magazine well 14 and the hand grip 8. In an exemplary embodiment, the trigger may be a two-stage trigger. As known in the art, the magazine 16 is released from the magazine well 16 upon pressing the magazine button 88. The upper receiver defines an ejector port that is covered by an ejector port flap 23 that is held to the upper receiver though an ejector flap pin 25 and spring 27.

Referring to FIGS. 9 and 11, the lower receiver 6 includes a safety selector 104 for providing a safe and fire mode for the firearm. The safety selector is held to the receiver by a safety detent 86 and safety detent spring 85. The lower receiver also includes a rebound buffer 107 that is mounted to the inside end of the receiver through the use of a buffer screw 108. The lower receiver 6 also includes the trigger guard 21 that is pinned to the receiver through the use of a pin 90. Pivot pin 96 and takedown pin 112 extend through openings in the side of the lower receiver to mount the lower receiver 6 to the upper receiver 7. Pivot pin spring 97, pivot pin detent 98, takedown pin spring 110 and takedown pin detent 111 may be used to hold the respective pins 96 and 112 to the lower receiver. The lower receiver 6 also includes magazine catch and release components, including the magazine release button 88, magazine catch spring 89 and magazine catch 99. The magazine catch and release components are used to hold the magazine 16 in the magazine well 14 and to release the magazine from the well upon pressing the magazine release button 88. Various magazines may be used with the firearm. Moreover, the lower receiver includes a bolt catch 103, bolt catch plunger 101, bolt catch spring 100 and bolt catch roll pin 102. Mounted to the lower receiver is the pistol grip 8 which is secured to the lower receiver through the use of a pistol grip screw 82 and washer 83. In an exemplary embodiment, the pistol grip may be a Hogue rubber pistol grip. Mounted to the back of the lower receiver is a sling adapter base 176 on which may be mounted a sling adapter, not shown. The receiver includes the trigger 22, hammer 51, springs 53 and mounting pins 54 that are used to fire the firearm, as known in the art.

The handguard 10 is mounted around the barrel 20 and is secured via screws 43 to front and rear handguard brackets 45. The barrel 20 is mounted through openings 47 formed in the brackets 45. The handguard 10 may be made of a hard polymer and may wrap at least partially around the barrel and may define a plurality of ribs 49 which serve as a handgrip to assist the operator in handling the firearm. Alternatively, the handguard 10 may define one or more rails that surround the barrel and on which may be mounted firearm accessories, including lights and optics. Other handguard configurations are possible with the invention. The handguard protects the operator's hand from the heat generated from the barrel after the firearm is fired.

The barrel 20 is mounted at one end to the upper receiver 7 through the use of a barrel nut 17 which threads onto a threaded end 57 of the upper receiver. At the other end, the barrel passes through a gas piston housing 122 and threadably connects to an optional flash hider 1. A crush washer 2 may be positioned between the flash hider 1 and the threaded end of the barrel. The barrel 20 may include one or more ports 58 in the barrel wall that permit discharged gases to escape and pass into the gas piston housing 122.

The gas piston system of the invention includes the gas piston housing 122 that defines generally a rectangular configuration and is slidably mounted to the top rail 52. The gas piston housing may be slidably mounted at its top wall to the top rail 52 through a tongue and groove configuration, a dovetail configuration, or other techniques. Alternatively, the gas piston housing may be fixedly mounted to the top rail 52 through the use of fasteners or the like. The gas piston housing 122 defines an opening 124 for receiving the barrel 20 and for permitting the barrel to pass therethrough. The gas piston housing 122 also includes a side opening 126 positioned above the opening 124 for receiving a gas regulator 118 that may be used to control the amount of gas passing through the gas piston system. A gas regulator detent 119, spring 120 and locking pin 121 may be used to hold the gas regulator 118 within the housing 122. The gas regulator 118 may be a two position regulator and may be adjusted manually by turning the regulator within the housing through the use of a screwdriver or similar tool. The gas regulator is adjustable so the operator can adjust the gas flow through the gas piston housing for semi-automatic use and for various types of ammunition, which have different pressures which can cause what is known as short stroke or excessive pressure concerns within the gas piston housing.

Figure 2:
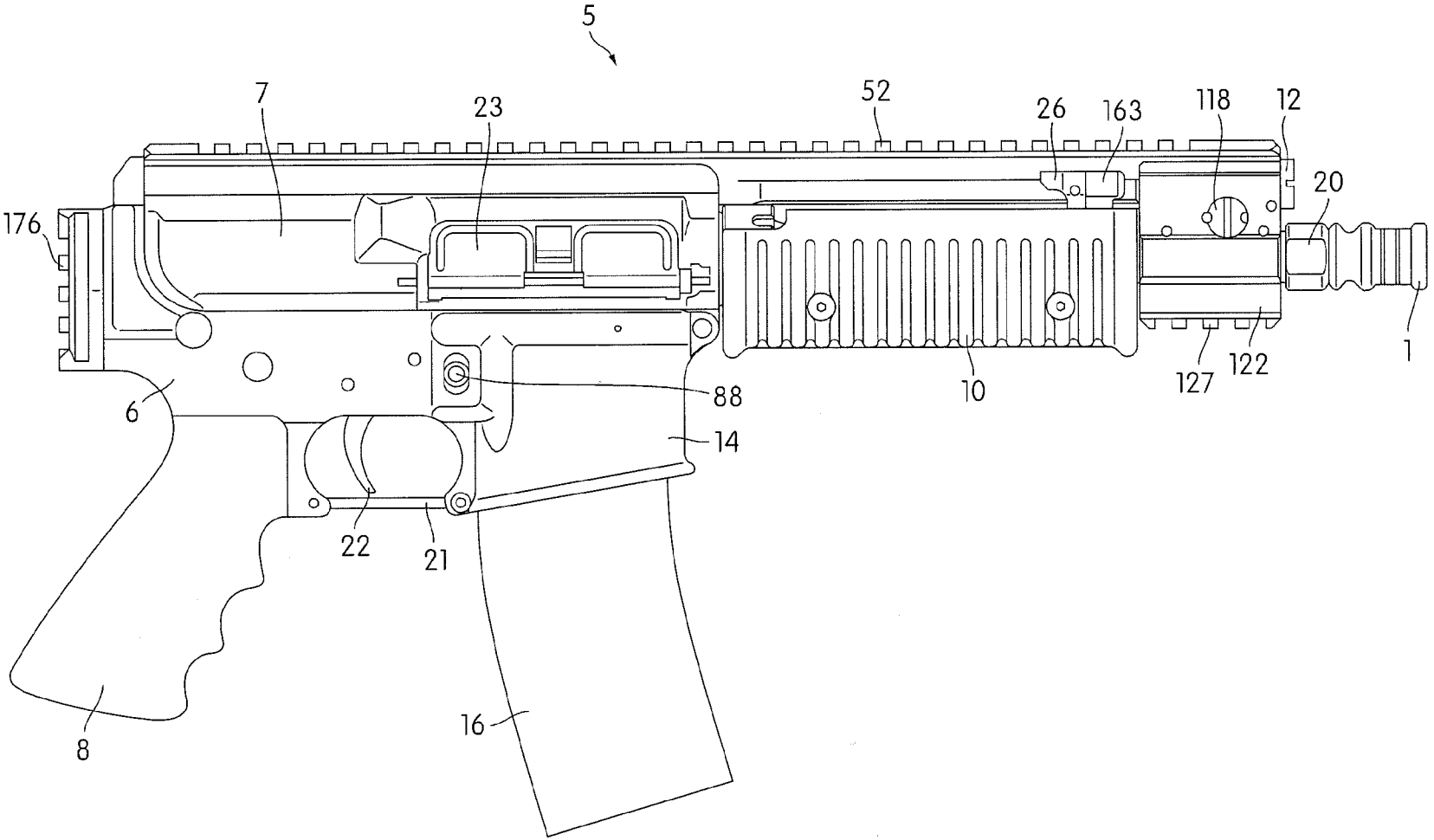
FIG. 2 illustrates a side elevation view of the firearm of FIG. 1.
Figure 3:
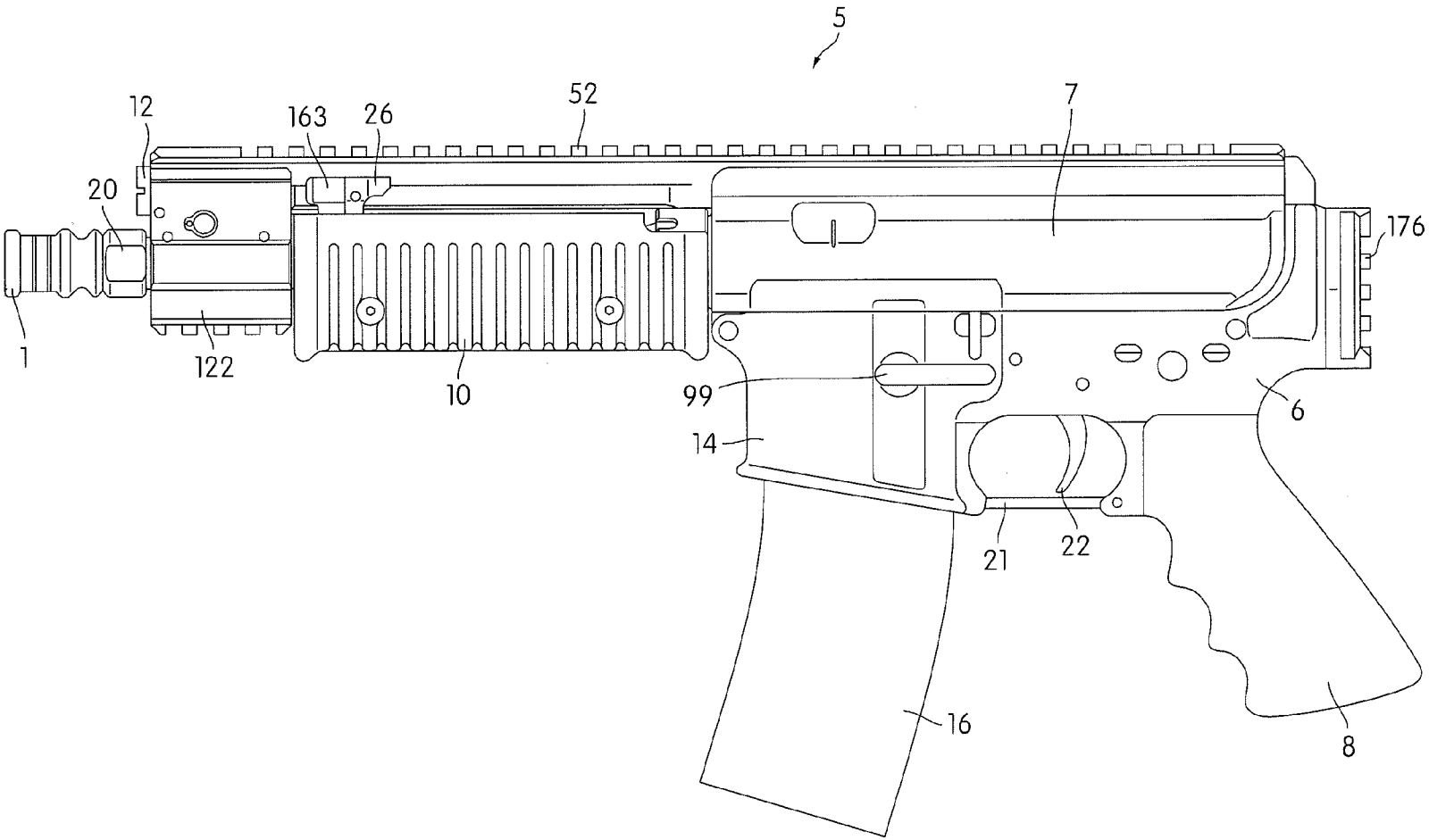
FIG. 3 illustrates another side elevation view of the firearm of FIG. 1.
Figure 4:
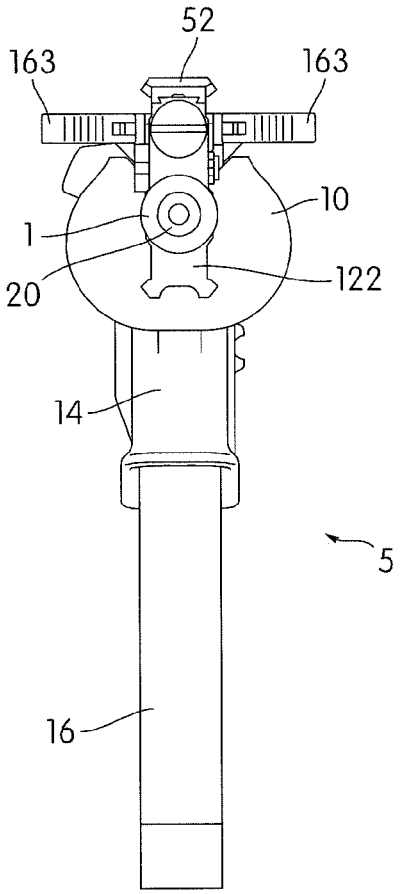
FIG. 4 illustrates an end elevation view of the firearm of FIG. 1.
Figure 5:
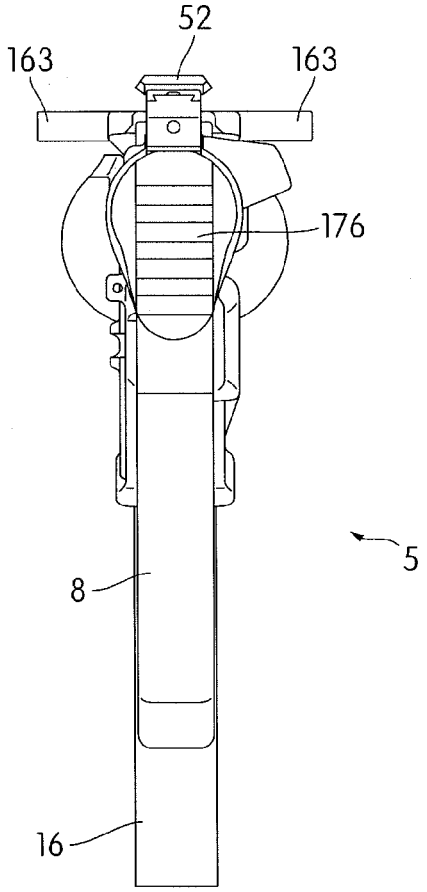
FIG. 5 illustrates another end elevation view of the firearm of FIG. 1.
Figure 6:
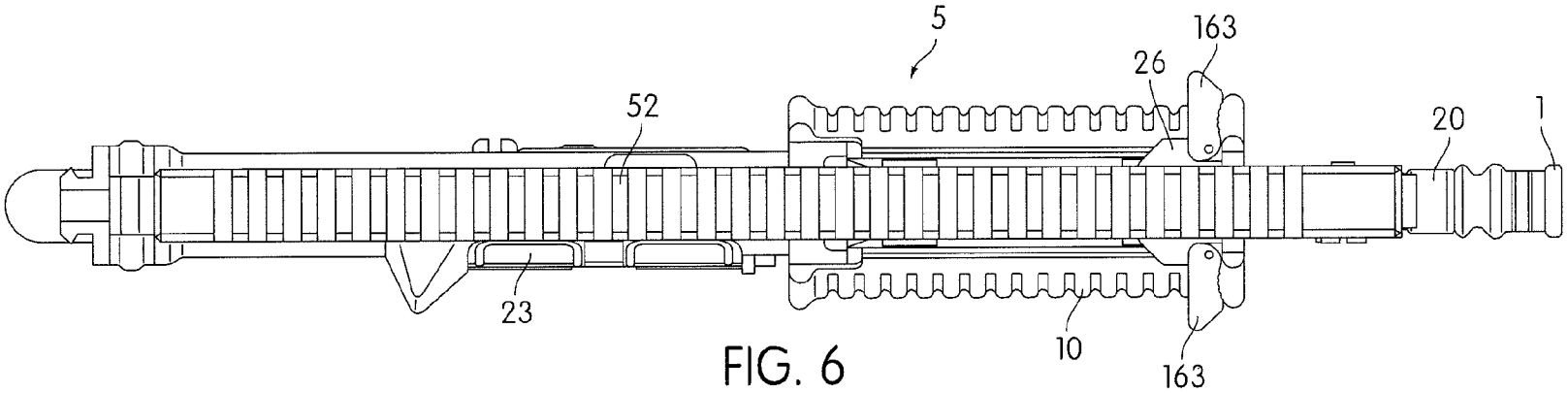
FIG. 6 illustrates a top view of the firearm of FIG. 1.

The gas piston housing 122 is configured to receive a piston 11 that is operatively connected to a guide rod 130 to form a piston-rod assembly. The piston 11 is cylindrical in shape and will move within the housing 122 when exhaust gases from a fired cartridge pass through the barrel port 58 into the housing 122 and act on the head of the piston 11. The piston 11 will in turn drive the operatively connected rod 130 toward the rear of the firearm. A piston housing plug screw 12 is positioned at an end of the piston housing and may be held in position by a roll pin 13. Gas piston housing screws 123 may be mounted through a side of the piston housing 122. As shown in FIGS. 2 and 7, the gas piston housing 122 may include one or more rails 127 on one or more sides of the piston housing on which to mount accessories, such as lights and optics.

The guide rod 130 is operatively connected at one end to the piston 11 and is further connected at the other end to a guide rod base 132. A guide rod washer 131 and guide rod roll pin 133 may be used to hold the guide rod base 132 onto the guide rod. A coiled, action spring 72 is positioned around the guide rod along the majority of the length of the rod. The spring 72 opposes the forces exerted by the piston 11 during cycling of the firearm. Operatively connected to the guide rod base 132 is an operating rod housing 29. The rod housing 29 defines an elongated tube 129 with a through passageway 141 that receives the rod 130 and spring 72 and mounts to the bolt carrier 32 through the use of housing screws 28. The elongated tub 129 defines an exterior surface that is shaped to match an interior channel 143 formed in the upper receiver 7. The elongated tube 129 defines an end 145 that serves as the striking point for the gas piston 11 during operation of the firearm.

The upper receiver 7 slidably-mounts to the elongated top rail 52 that extends the length of the upper receiver and beyond. The elongated top rail 52 houses and aligns the numerous components of the firearm, including the gas piston housing 122, the handguard brackets 45, the bolt carrier housing 32, the operating rod housing 29 and guide rod 130. With this configuration, the primary action components of the firearm will be more accurately aligned to improve the performance of the firearm. The rail 52 may define a top surface that may be used to mount numerous accessories to the firearm, including lights and optics. Any of the rails used with the firearm 5 may be tactical rails and may comprise a series of ridges 161 with a T-shaped cross-section interspersed with flat spacing slots. Optics, for example, are mounted either by sliding them on from one end of the rail or the other, by means of a "rail-grabber" which is clamped to the rail with bolts, thumbscrews or levers, or onto the slots between the raised sections.

Slidably mounted to the underside of the rail 52 is a charging handle assembly 26 that may include a pair of opposing ears 163 that can be operated by either hand to charge the firearm. The charging handle assembly will mount to a channel formed in the underside of the rail and will slide along the underside of the rail. Unlike traditional charging handles, the charging handle 26 is located forward on the firearm. The opposing ears 163 may be pinned, through the use of pins 165, and folded against the side of the firearm when not in use. The opposing ears permit ambidextrous use of the charging handle. The forward located charging handle 26 is non-reciprocating. The charging handle is not affixed to the operating rod so the charging handle does not run back and forth when the firearm cycles. In other words, in the exemplary embodiment, the charging handle does not serve as a forward assist to the bolt carrier.

The firearm 5 also includes the bolt 34 and bolt carrier 32. The bolt includes an extractor 37, extractor pin 38, extractor spring 35 and spring insert 36. Also included on the bolt are an ejector 41, ejector spring 40 and ejector roll pin 39. The bolt carrier includes a cam pin 31. Positioned within the bolt 34 is a firing pin 27 that is held in position by a firing pin retaining pin 30. The bolt carrier is configured to be shorter than a standard bolt carrier without the forward assist notches. The bolt carrier may include two dovetail cuts in the top of the bolt carrier to relieve the stresses off of the key screws so as to prevent the key screws from shearing off during use. Additionally, the bolt carrier tail diameter has been increased. By increasing the bolt carrier tail diameter and installing the dovetail in the top of the carrier there is a reduced chance of shearing of the key screws.

In operation, the operator can handle the firearm 5 by grasping the handguard 10 in one hand while holding the pistol grip 8 in the other hand. The bolt assembly strips a cartridge from the magazine and moves the cartridge forward into the barrel as the bolt assembly moves toward a battery position. Once the bolt assembly is in the battery position, the operator can activate the trigger. The trigger releases the cocked hammer and the hammer strikes the firing pin, as known in the art. The firing pin moves forward and makes contact with the cartridge. The contact between the firing pin and the cartridge causes the cartridge to fire and the resultant explosion forces a bullet out the end of the barrel along a forward path and in the direction the barrel is pointing. The resultant explosion also causes the bolt assembly to recoil in a backward direction opposite of the direction of bullet travel. This is accomplished through the piston driven system of the invention which includes the elongated rod that is operatively connected to the bolt assembly. The exhaust gases from the fired cartridge travel through an opening in the barrel and into the piston housing and in contact with the piston head of the piston-rod assembly, located above the barrel. The piston-rod assembly will drive the operatively connected bolt assembly in the direction away from the direction of the fired bullet. The movement of the bolt assembly in turn allows the spent cartridge to be ejected. Once the piston has traveled a certain distance, the remaining unused gases acting on the piston is discharged through the piston housing. The coiled spring around the piston rod will oppose the backward travel of the bolt assembly and will move the rod assembly and bolt assembly forward so that another cartridge can be stripped from the magazine and the bolt assembly can be returned to the battery position.

Figure 10:
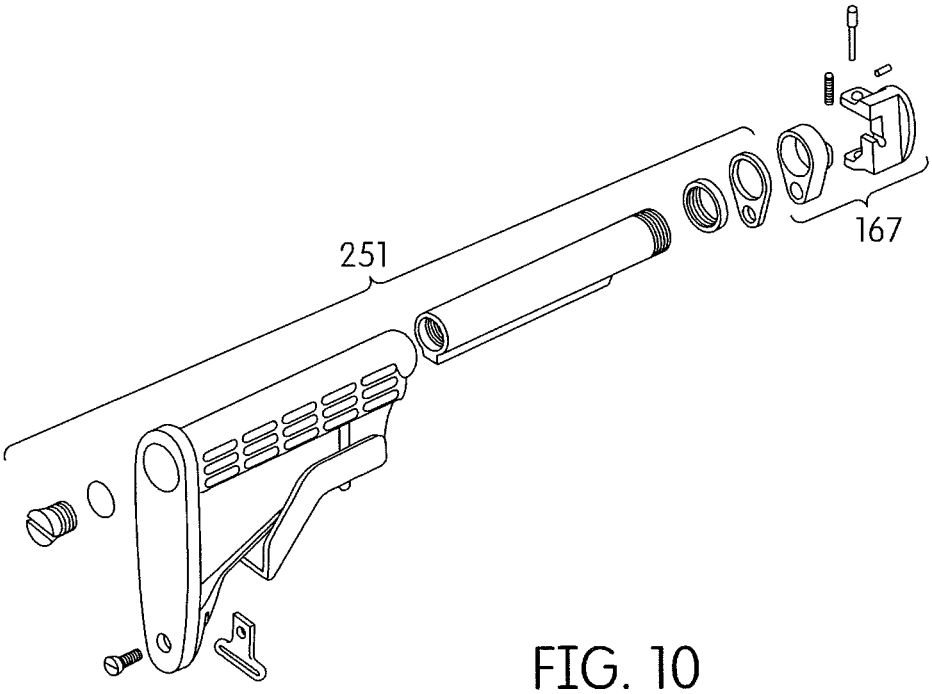
FIG. 10 illustrates an exploded view of an exemplary foldable stock that may be mounted to the firearm of FIG. 8.

Referring to FIG. 8, there is depicted an alternative exemplary firearm 3 that is in the configuration of a carbine. The firearm 3 includes mostly the same components of firearm 5. The firearm 3 includes a longer barrel 20, handguard 10 and rail 52. As depicted in FIG. 10, an optional foldable stock 251 may be mounted to an end of the lower receiver. The foldable stock may define numerous configurations and may define means for mounting sling adapters and other accessories. A hinge assembly 167 may be used to mount the foldable stock to the lower receiver.

It is to be understood that the invention is not limited in its application to the details of construction and the arrangement of the components set forth herein and illustrated in the drawings. The invention is capable of other embodiments and of being practiced or being carried out in various ways. Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention.

What is claimed is:

1. A firearm having a gas piston system, the firearm comprising:

a lower receiver, an upper receiver mounted to the lower receiver, a barrel mounted to the upper receiver, a handguard surrounding at least part of the barrel, an elongated mounting rail defining a first side and an opposite second side, the upper receiver extending from the second side of the elongated mounting rail, a gas piston housing operatively mounted to the barrel and positioned forward of the upper receiver, the gas piston housing aligned with the second side of the elongated mounting rail, a piston and rod assembly operatively mounted to the gas piston housing and positioned above the barrel, the piston and rod assembly including a guide rod and spring, the guide rod is operatively connected at a first end of a piston and is further connected at a second end to a guide rod base, the spring positioned around the guide rod along at least a portion of a length of the guide rod, the piston and rod assembly operatively connected to an operating rod housing which is operatively connected to a bolt carrier in the upper receiver, the operating rod housing defining an elongated tube with a through passageway that receives the guide rod and spring of the piston and rod assembly, and a charging handle operatively connected to the bolt carrier, wherein the elongated mounting rail aligns the gas piston housing and piston and rod assembly.

2. The firearm of claim 1, wherein the elongated mounting rail aligns the gas piston housing to the upper receiver.

3. The firearm of claim 2, further comprising a guide rod base mounted to an end of the rod.

4. The firearm of claim 1, wherein the bolt carrier defines two dovetail cuts in the top side of the bolt carrier to relieve the stress off of key screws which mount the elongated tube to the bolt carrier.

5. The firearm of claim 4, wherein the elongated tube operatively mounts to the two dovetail cuts in the bolt carrier.

6. The firearm of claim 5, wherein the dovetail cuts are located on the bolt carrier on opposite sides of a cam pin which is operatively mounted to the bolt carrier.

7. The firearm of claim 1, wherein the charging handle is ambidextrous and non-reciprocating, includes foldable ears and is mounted to the second side of the elongated rail.

8. The firearm of claim 7, where in the charging handle is positioned above the handguard and between the upper receiver and gas piston housing.

9. The firearm of claim 1, wherein the upper receiver is slidably mounted to the second side of the elongated mounting rail.

10. The firearm of claim 9, wherein the upper receiver and gas piston housing are slidably mounted to the second side of the elongated mounting rail through a dovetail connection.

11. The firearm of claim 9, wherein the upper receiver and gas piston housing are slidably mounted to the second side of the elongated mounting rail through a tongue and groove connection.

12. The firearm of claim 10, wherein the gas piston housing defines an aperture for permitting gases to discharge therethrough.

13. The firearm of claim 1, wherein the charging handle is mounted to a channel formed in the second side of the elongated mounting rail and will slide along the second side of the rail.

14. The firearm of claim 1, wherein the gas piston housing defines a first opening for receiving the barrel and for permitting the barrel to pass through the gas piston housing, and wherein the gas piston housing defines a second opening positioned above the first opening for receiving a gas regulator.

15. The firearm of claim 1, wherein the elongated tube defines an exterior surface that is shaped to match an interior channel formed in the upper receiver.

16. The firearm of claim 15, wherein the elongated tube defines an end that serves as the striking point for the piston during operation of the firearm.

* * * * *